US007331144B2

(12) United States Patent
Parsadayan

(10) Patent No.: US 7,331,144 B2
(45) Date of Patent: Feb. 19, 2008

(54) SYSTEM AND METHOD FOR OPERATING A BARRIER WITH A TIMER

(76) Inventor: Walter Parsadayan, 21 Old Ranch Rd., Laguna Niguel, CA (US) 92677

( * ) Notice: Subject to any disclaimer, the term of this patent is extended or adjusted under 35 U.S.C. 154(b) by 262 days.

(21) Appl. No.: 11/033,645

(22) Filed: Jan. 12, 2005
(Under 37 CFR 1.47)

(65) Prior Publication Data

US 2006/0150511 A1 Jul. 13, 2006

(51) Int. Cl.
*E04H 9/00* (2006.01)

(52) U.S. Cl. ..... 52/1; 52/19

(58) Field of Classification Search ..... 52/1, 52/2.12, 2.15, 19; 318/283–286, 469
See application file for complete search history.

(56) References Cited

U.S. PATENT DOCUMENTS

| | | | | |
|---|---|---|---|---|
| 5,737,710 | A * | 4/1998 | Anthonyson | 701/1 |
| 6,091,217 | A | 7/2000 | Parsadayan | |
| 2003/0076062 | A1* | 4/2003 | Mullet et al. | 318/445 |
| 2005/0046584 | A1* | 3/2005 | Breed | 340/825.72 |
| 2005/0090915 | A1* | 4/2005 | Geiwitz | 700/90 |
| 2006/0101721 | A1* | 5/2006 | Weik et al. | 52/1 |

* cited by examiner

*Primary Examiner*—Wilson Lee
(74) *Attorney, Agent, or Firm*—Fitch, Even, Tabin & Flannery

(57) ABSTRACT

A pause profile is stored in a memory. An ambient condition is determined. The pause profile is accessed in the memory and a pause time is determined based upon the measured ambient condition. A moveable barrier is caused to remain in an open position for the pause time that is obtained from the memory.

6 Claims, 3 Drawing Sheets

*Fig. 4*

402 404 400

| TIME OF DAY | PAUSE TIME |
|---|---|
| 12:00 am - 6:00 am | 30 SECONDS |
| 6:00 am - 9:00 am | 2 MINUTES |
| 9:00 am - 12:00 pm | 1 MINUTE |
| 12:00 pm - 1:00 pm | 1.5 MINUTE |
| 1:00 pm - 4:00 pm | 1 MINUTE |
| 4:00 pm - 6:00 pm | 2 MINUTE |
| 6:00 pm - 10:00 pm | 1 MINUTE |
| 11:00 pm - 12:00 am | 45 SECONDS |

406 409 410

SYSTEM AND METHOD FOR OPERATING A BARRIER WITH A TIMER

FIELD OF THE INVENTION

The field of the invention relates to moveable barrier operators and, more specifically, to pausing the movement of a barrier using a timer.

BACKGROUND OF THE INVENTION

Different types of moveable barrier operators have been sold over the years and these systems have been used to actuate various types of moveable barriers. For example, garage door operators have been used to move garage doors while gate operators have been used to open and close gates.

Such barrier movement operators may include a wall control unit, which is connected to send signals to a head unit thereby causing the head unit to open and close the barrier. In addition, these operators often include a receiver unit at the head unit to receive wireless transmissions from a hand-held code transmitter or from a keypad transmitter, which may be affixed to the outside of the area closed by the barrier or other structure.

Frequently, it is advantageous for gate operators to have the ability to be hold a barrier in an open position for a period of time before returning the barrier to a closed position. For example, a garage door may need to be opened and held in the open position to allow vehicles or other objects to pass through a garage door. The door needs to be held in the open position for a time period such that all or most vehicles can pass the barrier. In such previous systems, a timer is often used to control the period of time during which the door is held in the open position.

In some previous systems, the expiration period of the timer is adjustable by the installer when the operator is installed. However, in these systems, the expiration period is thereafter fixed and could not be adjusted dynamically to take into account variations in traffic patterns at the barrier as conditions at the barrier changed. For example, this shortcoming resulted in the door having to be opened and closed multiple times when traffic was heavy to allow all of the traffic to proceed through the door. In other situations when traffic was lighter, the barrier might be left open for long periods of time when no vehicles were passing through the barrier, thereby creating security problems.

Some previous approaches adjusted the expiration period of the timer when the number of vehicles passing through the barrier increased or decreased. Although this technique increased/decreased the period of the timer to reflect traffic conditions, it was not effective in adjusting the period for a first set or sets of vehicles that came through the barrier. In other words, the initial sets of vehicles would always be subject to an inadequate pause time period, thereby increasing the possibility of a premature closing of the barrier. This technique also proved inadequate in situations where traffic patterns changed frequently and/or suddenly, for instance, at different times of the day or during different days of the week. Specifically, a substantial amount of time was often needed for the system to determine a traffic pattern change and make the timer adjustment. This amount of time often meant that the traffic pattern might change again before a first adjustment could even be made.

SUMMARY OF THE INVENTION

A system for actuating a moveable barrier uses an adjustable timer to cause the barrier to remain in an open position for the expiration period of the timer. Specifically, a pause profile is maintained that relates ambient conditions, such as time of the day, to pause times. The period of the timer is automatically adjusted with updated pause times as the ambient conditions at the barrier change. In other words, the time that the barrier remains in an open position dynamically changes as the ambient conditions at the barrier change.

In many of these embodiments, a pause profile is stored in a memory. One or more ambient conditions are also determined. Examples of ambient conditions that can be determined may be a time of a day, a day of a week, a month of a year, a day of a year, a temperature, rain, snow, ice, or a measured light intensity. Other examples of ambient conditions are also possible.

The pause profile is then accessed in the memory, for example, using the ambient condition as an index to obtain a pause time relating to the ambient condition. In this example of a pause profile, a table in memory may be used to store pause times that relate to specific days of the week or specific times of the day.

After the pause time has been determined, the moveable barrier is caused to remain in an open position for the pause time. After the expiration of the pause time at the timer, the barrier may be returned to a closed position.

In others of these embodiments, new traffic patterns are measured at the moveable barrier by a sensor. Once the new traffic patterns have been measured, the pause profile is dynamically adjusted based upon the new traffic patterns. Thus, actual traffic conditions at the barrier may be used to dynamically update the pause times in the pause profile.

In still others of these embodiments, the pause profile is fixed in memory at the time of manufacture and cannot be changed by the operator. However, in another approach, the pause profile that is fixed in memory at the time of manufacture may be modified when the moveable barrier operator is installed or some other suitable time. In this case, the operator may store new pause times in the pause profile at the time of installation that more closely correspond to actual traffic conditions at the barrier.

Thus, a system is provided that dynamically adjusts pause times of a moveable barrier based upon ambient conditions at the barrier. The approach avoids multiple cyclings of barriers when traffic is heavy or leaving barriers open for long periods of time when traffic is light. Further, the system is efficient since barriers are open for time periods based upon determined or measured historic conditions at the barrier. The system also requires no learning time. In other words, the first set of vehicles or objects that pass through the barrier will not be subjected to premature barrier closings or other adverse consequences.

BRIEF DESCRIPTION OF THE DRAWINGS

FIG. 4 is one example of a pause profile stored in a memory according to the present invention.

Skilled artisans will appreciate that elements in the figures are illustrated for ease of understanding and have not necessarily been drawn to scale. For example, the dimensions of some of the elements in the figures may be exaggerated relative to other elements to help to improve understanding of various embodiments of the present invention. Also, common but well-understood elements that are useful in a commercially feasible embodiment are often not depicted in order to facilitate a less obstructed view of the various embodiments of the present invention.

DESCRIPTION OF THE PREFERRED EMBODIMENTS

Figure 1:
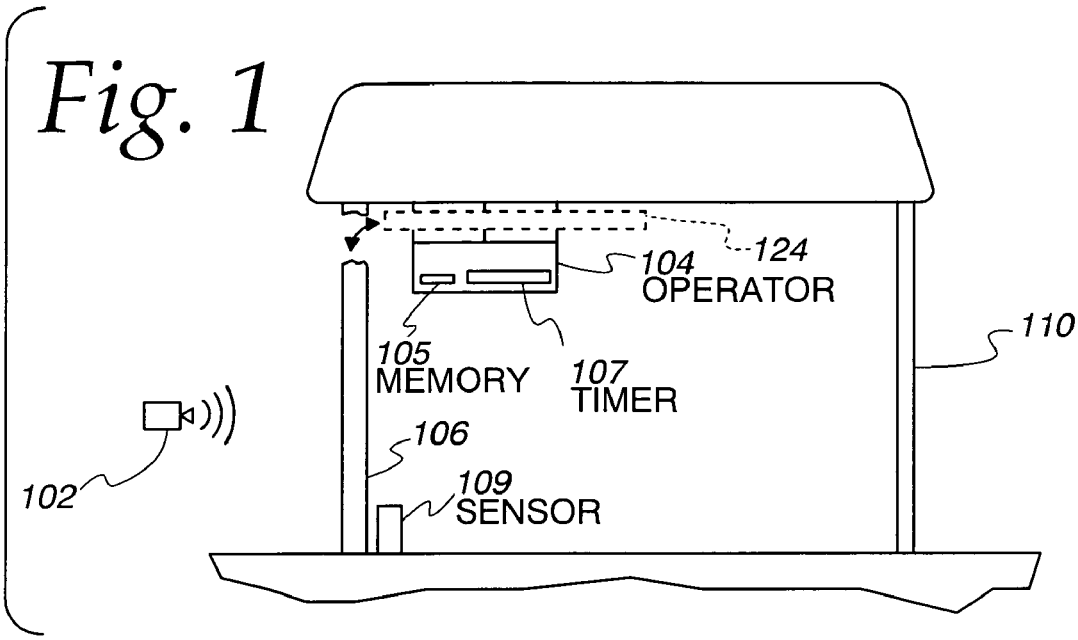
FIG. 1 is a block diagram of a system for actuating a movable barrier operator according to the present invention.

Referring now to the drawings and especially FIG. 1, one example of a system that uses a timer to pause the movement of a moveable barrier is described. A transmitter 102 sends a signal to a movable barrier operator 104. The transmitter 102 may be a portable handheld device that transmits a signal to the operator 104. The signal may be coded or uncoded. In another example, the transmitter 102 may be a fixed keypad rather than a portable device.

The operator 104 actuates a barrier 106. The barrier 106 may be a door, fire gate, sliding gate, swinging gate, barrier arm, chain barrier, window shutters, or any other type of barrier. The barrier operator 104 may be any type of operator that is used to move these barriers between open and closed positions, for example, a garage door opener or gate operator. In the example of the system illustrated in FIG. 1, the operator 104 is a garage door operator that is housed within a garage 110.

In one example of the operation of the system of FIG. 1, the movable barrier 106 is moved from a closed position to an open position. A pause profile is stored in a memory 105 at the operator 104. Ambient conditions are determined at the movable barrier 106 (shown here in a closed position). The pause profile is accessed in the memory 105 and a pause time is determined based upon the measured ambient conditions. The moveable barrier 106 is caused to remain in an open position 108 for the pause time (that is obtained from the memory 105). After the timer 107 expires, the barrier 106 may be returned to the closed position.

The pause time may be adjusted after a predetermined amount of time has expired. For instance, the pause profile may be consulted every hour and a new pause time obtained. If the pause time changes from one consultation to the next, the new pause time may be applied to the timer.

New traffic patterns may also be measured at the barrier 106 by a sensor 109. After the new traffic patterns are determined by the sensor 109, the profile in the memory 105 may be dynamically adjusted to take into account the new traffic patterns. For example, if the profile relates times of the day to pause times, and new traffic patterns indicate that a previously inactive period of the day is suddenly active, the pause time for the newly busy period of the day may be increased to reflect the new traffic patterns. The sensor 109 may be any type of device that detects the amount and/or direction of traffic past the barrier 106.

The pause profile may be fixed in the memory 105. In this regard, the pause profile may be fixed in the memory 105 at the time of manufacture of the operator 104. However, in another example, a fixed profile may be altered by a user when the operator is installed or at some other suitable time. In yet another example, the profile may be received with a default profile. This profile would then update the operation of the barrier operator is recorded.

As mentioned above, the profile stored in the memory 105 relates pause times to various ambient conditions. By way of example, the ambient conditions may be a time of the day, a day of the week, a week or month of the year, a specific day of the year, a holiday, a light intensity at the barrier, rain, ice, snow, or a temperature. Other examples of ambient conditions are possible.

In the memory 105, the profile may be represented by any suitable data structure. For example, the profile may be a table relating specific pause times to certain time periods during the day. Alternatively, the pause profile may be in the form of an equation where applying ambient conditions to the pause profile gives a pause time. Other data structures and approaches for representing pause profiles are possible.

Figure 2:
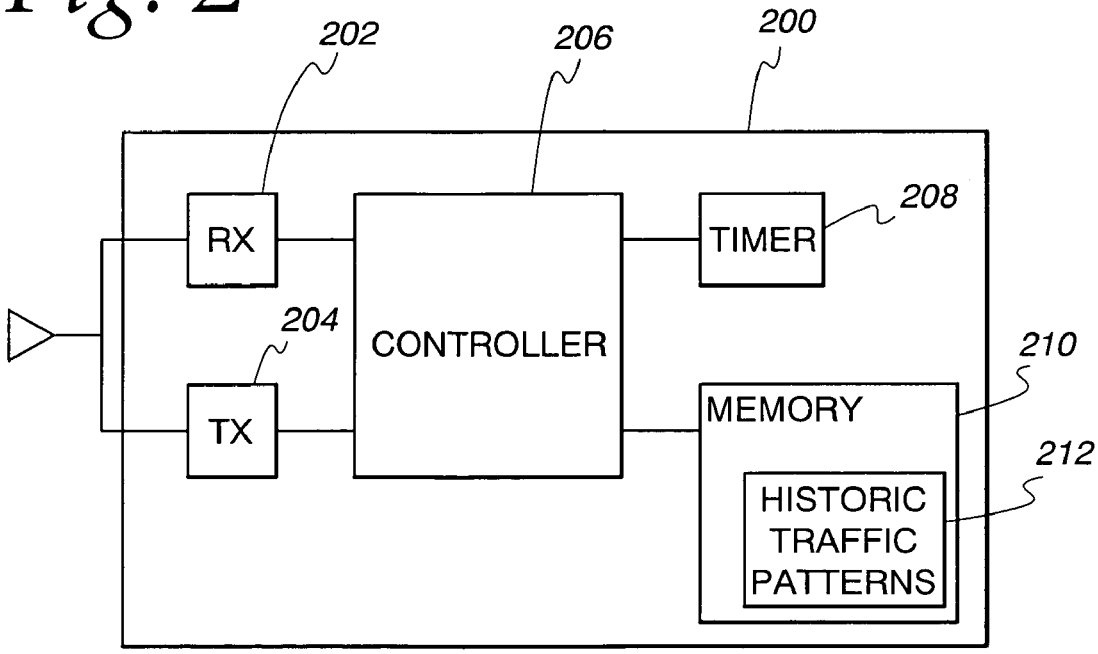
FIG. 2 is a block diagram of a moveable barrier operator according to the present invention.

Referring now to FIG. 2, one example of a movable barrier operator is described that uses a timer to pause the movement of a moveable barrier in an open position. A controller 206 is coupled to a receiver 202, a transmitter 204, a timer 208, and a memory 210.

The memory 210 stores a pause profile 212. The pause profile 212 comprises data relating a pause time to ambient conditions such as the time of a day, day of a week, calender year, holiday, or other criteria. In another example, the pause profile stores a running average of the amount of traffic moving through the moveable barrier and relates this to pause times. In still another example, the pause profile may be an equation that is used to obtain the pause time by entering the measured ambient condition and then obtaining the pause time from the equation. Other data structures and approaches are possible to represent the pause profile 212.

In one example, the pause profile 212 is fixed and not adjustable. That is, once the profile is programmed into the memory, it cannot be changed. In another example, a human operator can manually overwrite the profile at any time.

In still another example, traffic patterns are measured in real time at the barrier by a sensor and the pause profile itself is adjusted dynamically based upon these new traffic patterns. An example of dynamically adjusting the pause profile is described in connection with FIG. 4.

Once the pause time has been determined, the controller 206 sends a signal to the transmitter 204 to move the barrier to the open position. The controller 206 is further programmed to transmit a pause signal to the motor at the moveable barrier to maintain the barrier in the open position for the period of the timer. The controller 206 may transmit a close signal to close the barrier after the period has expired.

The controller 206 is further programmed to automatically adjust the period of the timer based at least in part upon the pause profile. For example, the controller 206 may consult the profile every one hour and determine a new pause time at each hour. If the new pause time is the same as the old pause time, then the pause time as used by the timer is not adjusted. However, if the new pause time is different from the current expiration period of the timer, then the timer period is set to the new pause time.

Figure 3A:
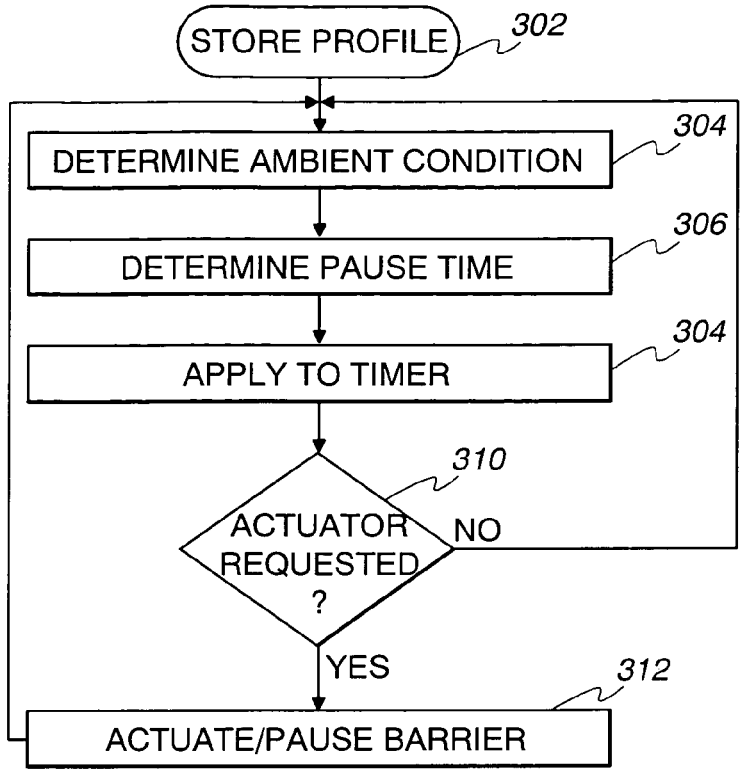
FIG. 3*a* is a flowchart of an approach for operating a movable barrier operator according to the present invention.

Referring now to FIG. 3*a*, one example of an approach for operating a movable barrier operator is described. At step 302, a pause profile is stored in memory. The pause profile relates pause times to ambient conditions. In one example, the pause profile may be a table that relates times of the day to pause times. In another example, the pause profile may be an equation that yields a pause time when variable ambient conditions are applied to the profile.

At step 304, an ambient condition or conditions are determined. For example, the ambient condition may be a time of the day, a day of the week, a week or month of the year, a specific day of the year, a holiday, a light intensity at the barrier, rain, snow, ice, or a temperature. At step 306, the ambient condition is used to determine a pause time from the pause profile stored in the memory. The system, for example, may examine a lookup table stored in a memory to determine the appropriate pause time if the pause profile is stored in tabular form.

At step 308, the pause timer uses the pause time is stored in or applied to the timer. At step 310, the system determines if an indication to actuate the operator has been received. For instance, the system may receive a signal from a transmitter to open the barrier. If the answer is negative, the control continues at step 304. The determination of the conditions (step 304) may occur periodically, for example, every 30 minutes to reduce the quantity of readings required per day. If the answer is affirmative, at step 312, the barrier is actuated and the barrier pauses in an open position for the pause time. Execution then continues at step 304 as described above.

Figure 3B:
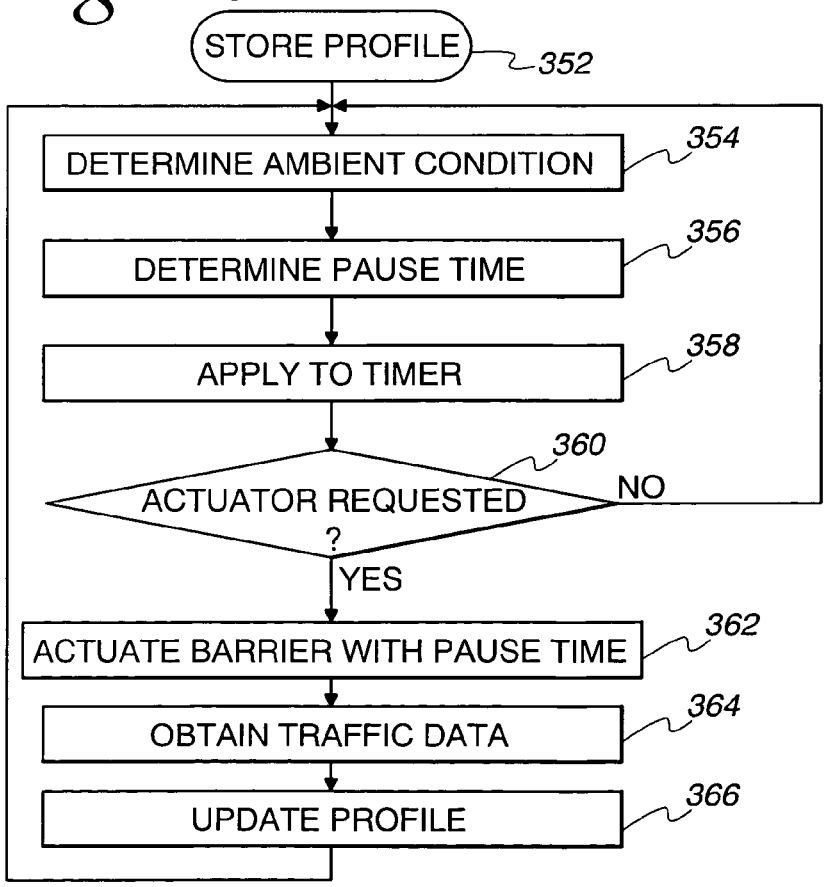
FIG. 3*b* is a flowchart of another approach for operating a movable barrier operator according to the present invention.

Referring now to FIG. 3*b*, another example of an approach for operating a movable barrier operator is described. At step 352, a pause profile is stored in memory. The pause profile relates pause times to ambient conditions. In one example, the pause profile may be a table that relates times of the day to pause times. In another example, the pause profile may be an equation that yields a pause time when variable ambient conditions are applied to the profile.

At step 354, ambient conditions are determined. For example, the ambient condition may be a time of the day, a day of the week, a week or month of the year, a specific day of the year, a holiday, a light intensity at the barrier, rain, snow, ice, or a temperature. At step 356, the ambient conditions are used to determine a pause time from the pause profile stored in the memory. The system, for example, may examine a lookup table stored in a memory to determine the appropriate pause time if the pause profile is stored in tabular form.

At step 358, the pause timer uses the pause time is stored in or applied to the timer. At step 360, the system determines if an indication to actuate the operator has been received. For instance, the system may receive a signal from a transmitter to open the barrier. If the answer is negative, the control continues at step 354. The determination of the conditions (step 354), may occur periodically, for example, every 30 minutes to reduce the quantity of readings required per day. If the answer is affirmative, at step 362, the barrier is actuated and the barrier pauses in an open position for the pause time. Execution then continues at step 354 as described above.

At step 364, traffic condition information as measured at a sensor at the barrier is obtained. For example, a number of vehicles or other objects passing through the barrier over a given time period are measure. Step 364 may be performed every time a barrier is actuated or, alternatively, after the expiration of a time period (e.g., every hour). At step 366, this information is used to adjust the profile. For example, if during a period during the day traffic increases to a level so that the pause time for that period is inadequate, the pause time may be adjusted to reflect the new traffic level. An equation, table or some other approach may be used to select the new pause time. Execution then continues with step 354 as described above.

Referring now to FIG. 4, an example of a pause profile 400 is described. The pause profile 400 includes a column 402 indicating a time of a day. The pause profile 400 also includes a column 404 for pause times. It will be understood that the table shown in FIG. 4 is only one example of how a pause profile may be represented and other structures or approaches are possible.

The rows in the profile 404 relate the time periods of the day to pause times. By way of example, a row 406 indicates that the 12:00 a.m to 6:00 a.m. time period has a pause time of 30 seconds. The row 409 indicates that the 6:00 a.m. to 9:00 a.m. time period has a corresponding pause time of two minutes. The row 410 indicates that times falling in the 9:00 a.m. to 12:00 p.m. time period have a pause time of one minute. The other rows indicate similar relationships between time periods and pause times.

A moveable barrier operator uses the profile 400 to determine a pause time based upon measured ambient conditions. In this example, a time of day is determined. This determination may be made at preset intervals during the day. This determined time of day is then used as an index to determine a pause time from the pause profile 400. For instance, if it were determined that the current time were 9:02 a.m., then the system would access the row 410 because pause times corresponding to 9:02 a.m. are located in row 410. The system then retrieves the pause time (1 minute) and may temporarily store this value at a memory location. The pause time for the timer is subsequently set to one minute ensuring that if the moveable barrier is opened during the 9:00 a.m. to 12:00 p.m. time period, the barrier is retained in the open position for one minute before being closed.

As mentioned previously, the profile 400 may be dynamically changed. In this regard, new traffic patterns may be measured at the barrier by a sensor or the barrier itself and the entries in the table may be adjusted accordingly. For example, if traffic monitoring indicates that heavy traffic occurs in the 1:00 p.m. to 4:00 p.m. time period, then the pause period in row 410 may be changed from one minute to two minutes, or some other calculated or predetermined value. In addition, the rows can be split. For instance, if it were determined that heavy traffic were occurring only in the 1:00 p.m. to 2:00 p.m. time frame, then the row 410 could be split into two rows with one row retaining the one minute pause period and the other row having the new pause period.

While there has been illustrated and described particular embodiments of the present invention, it will be appreciated that numerous changes and modifications will occur to those skilled in the art, and it is intended in the appended claims to cover all those changes and modifications which fall within the true scope of the present invention.

What is claimed is:

1. A method of operating a moveable barrier operator comprising:

moving a movable barrier from a closed position to an open position;

storing a pause profile in a memory;

determining an ambient condition selected from the group consisting of time of a day, a day of a week, a month of a year, a day of a year, a temperature, and a measured light intensity;

accessing the pause profile and determining a pause time based upon the measured ambient condition;

measuring traffic patterns at the moveable barrier and adjusting the pause profile based upon a change in traffic patterns; and causing a moveable barrier to remain in an open position for the pause time, the causing the movement of the movable barrier to remain in an open position comprises pausing the movement of the moveable barrier when the open position is reached, maintaining the barrier in the open position for the pause time, and returning the barrier to a closed position after the pause time has expired.

2. The method of claim 1 wherein storing a pause profile comprises storing a plurality of pause times relating to times of days of a week.

3. A moveable barrier operator comprising:

a memory which stores a pause profile;

a transmitter which transmits signals to actuate a moveable barrier;

a timer having an expiration period;

a sensor which senses traffic patterns, the pause profile being adjusted based upon changes in traffic patterns measured at the barrier by the sensor;

a controller coupled to the memory, the transmitter, and the timer, the controller programmed to receive an ambient condition and access the pause profile in memory and determine a pause time based upon the ambient condition selected from the group consisting of time of a day, a day of a week, a month of a year, a day of a year, a temperature, and a measured light intensity, the controller further programmed to set the expiration period of the timer to the pause time, the controller causing the movable barrier to remain in an open position during the pause time for the expiration period of the timer.

4. The operator of claim 3 wherein the pause profile comprises pause times relating to times of days of a week.

5. The operator of claim 3 wherein the pause profile is fixed at the time of manufacturing of the operator.

6. The operator of claim 3 wherein the pause profile is capable of manual adjustment and overwritten by a human user when the operator is installed.

* * * * *